United States Patent [19]

Butcher

[11] Patent Number: 4,930,774

[45] Date of Patent: Jun. 5, 1990

[54] BASEBALL PITCHING TRAINING APPARATUS

[76] Inventor: Gary J. Butcher, 4 Shady Vista Rd., Rolling Hills Estate, Palos Verdes, Calif. 90274

[21] Appl. No.: 311,139

[22] Filed: Feb. 15, 1989

Related U.S. Application Data

[62] Division of Ser. No. 34,688, Apr. 6, 1987, Pat. No. 4,826,164.

[51] Int. Cl.[5] ..... A63B 69/00

[52] U.S. Cl. ..... 273/26 A

[58] Field of Search ..... 273/26 A, 29 A, 410, 273/400; D21/5

[56] References Cited

U.S. PATENT DOCUMENTS

| | | | |
|---|---|---|---|
| 1,567,384 | 12/1925 | Rectenwaldi et al. | 273/26 A |
| 2,059,365 | 11/1936 | King | 273/26 A |
| 2,162,438 | 6/1939 | Letaret | 273/26 A |
| 2,254,986 | 9/1941 | Ziel | 273/26 A |
| 2,964,316 | 12/1960 | Rose | 273/26 A |
| 2,974,246 | 4/1961 | Groninger | 273/26 A |
| 3,633,909 | 1/1972 | Doynow | 273/26 A |
| 3,658,329 | 4/1972 | Ciccarello | 273/26 A |
| 3,822,883 | 7/1974 | Vos | 273/26 A |
| 4,254,952 | 3/1981 | Playten, Jr. | 273/26 A |
| 4,497,485 | 5/1985 | Mascosko | 273/26 A |
| 4,629,188 | 12/1986 | Mahieu | 273/26 A |

*Primary Examiner*—Theatrice Brown

*Attorney, Agent, or Firm*—Edward E. Roberts

[57] ABSTRACT

Pitching training apparatus including selected target areas. The target areas are supported on a base fabric of netting material. The netting material provided with openings which define a pair of spaced target areas thereon. A netting material is loosely attached over and around each of the openings for retaining balls which pass therethrough. The base fabric is suspended from an overhead support member. A weight is attached to the lower end of the base fabric to hold the fabric in a vertical plane. One target area is generally elongate and rectangular, with another target area being of a configuration akin to a rectangle with a corner removed, with a portion of both of these target areas being in those areas of the strike zone corresponding to inside or outside edges and the corners of the strike zone.

6 Claims, 1 Drawing Sheet

BASEBALL PITCHING TRAINING APPARATUS

This is a division of application Ser. No. 07/034,688, filed 04/06/87 (Patent No. 4,826,164).

BACKGROUND OF THE INVENTION

The background of the invention will be discussed in two parts.

1. Field of the Invention

This invention relates to baseball pitching training apparatus, and more particularly to such apparatus including nets for retention of thrown balls.

2. Description of the Prior Art

In baseball, it is an object for the pitcher to throw the ball into an area defined as the strike zone, or at least in reasonable proximity thereto. Training aids for pitching practice have been devised to assist would be pitchers to enhance their throwing skill. One such apparatus is shown and described in U.S. Pat. No. 2,978,246, issued to Van Groningen on Apr. 4, 1961, such patent showing a target device including a generally rectangular generally transparent target plate of a size approximating the strike zone. The target plate is mounted on a pole member having a resilient portion to permit twisting or deflection on impact.

Another such related is U.S. Pat. No. 3,583,703, issued on June 8, 1971 to Brown, the apparatus therein including a framework formed of releasable and connectable tubular members, with string members suspended therein to define a strike zone, which is divided into four generally equally dimensioned parts.

Yet another such related device is shown in U.S. Pat. No. 3,312,467, issued Apr. 4, 1967 to Rawson, and shows another open framework with strike zone.

Another such framework, in the form of a silhouette of a batter supporting an open strike zone is shown in U.S. Pat. No. 3,658,329, issued Apr. 25, 1972 to Ciccarello.

U.S. Pat. No. 3,633,909, issued to Doynow on Jan. 11, 1972, and discloses another pitching practice aid, including a simulated batter and a generally rectangular and adjustable frame supported on a spring loaded post with a net device within the frame.

Another pitching training device is disclosed in U.S. Pat. No. 4,173,337, which issued to Okonowski on Nov. 6, 1979. The apparatus disclosed therein includes a framework supporting a plurality of hingedly connected and/or suspended rectangular, preferably rubber, pads arranged in a way to define an opening corresponding to the strike zone.

With such prior art devices, the object of the practice is to pitch into the strike zone, which includes or excludes some target device, such as a plate, net or the like. In actual pitching, however, control of the ball is of paramount importance. That is, pitching the ball over the center of the plate, at the right height will result in more base hits, which is opposite what the pitcher wants, or intends. The true object in pitching is to pitch the ball to the outside edges, inside edges, or the corners of that area defined as the strike zone, preferably while at the same time keeping the ball low, or high, depending upon whether it is an inside or outside pitch. In this manner, the batter is generally not able to put full and direct force into the ball, thus Causing pop flies, grounders, and foul balls, rather than base hits. Such pitches have the added advantage to the pitcher of providing the batter more of an opportunity to miss the ball entirely.

Accordingly, it is an object of the present invention to provide a new and improved baseball pitching training apparatus, which enables the pitcher to concentrate on pitching inside, outside, and to the corner of the strike zone, while at the same time keeping the ball either low or high.

It is another object of the invention to provide a new and improved baseball pitching training apparatus, which enables the pitcher to practice throwing the ball at selected locations outside of the strike zone, a portion of the target being outside of the strike zone.

Other objects, features and advantages will become apparent from a reading of the following specification, when taken in conjunction with the drawings, wherein like reference refer to like elements in the several views.

SUMMARY OF THE INVENTION

The foregoing and other objects of the invention are accomplished by providing baseball pitching training apparatus which includes three interconnected target areas, each in the form of an open framework supporting a ball catching device, such as a net. A first target area is generally elongate and rectangular, with a second target area being of a configuration akin to a rectangle with a corner removed, each of these areas located within a defined strike zone. The third target area is a continuation of the first and second target areas and is located outside of the strike zone.

The target area frames are supported on a common support, with the target areas in the area of the strike zone corresponding to inside or outside edges and the corners of the strike zone. The support may be embedded in the ground or in concrete, or may be detachable or on a swivel, with the base portion of the support being a base plate or spiked foot members.

DETAILED DESCRIPTION OF THE PREFERRED EMBODIMENT

Figure 1:
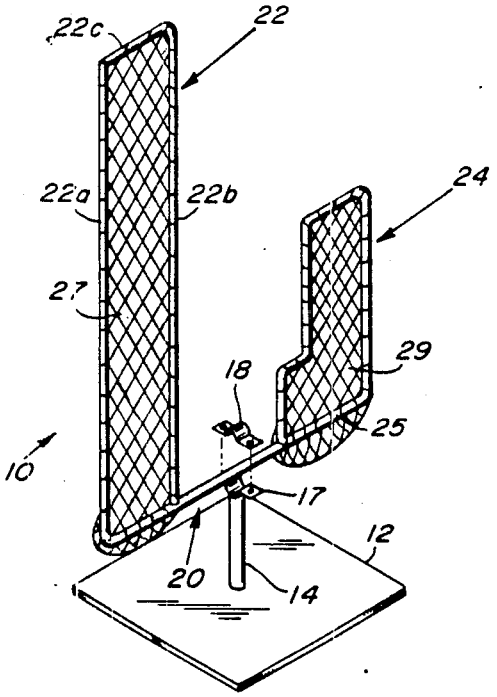
FIG. 1 is a perspective view of a baseball pitching training apparatus in accordance with the invention.

Referring now to FIG. 1 there is shown a baseball pitching training apparatus, generally designated 10, having a support means including a home plate or base plate 12 of generally square or rectangular form with a centrally positioned upwardly extending support post 14, the upper end of which may terminate with a saddle clamp 17, having a removable clamp member 18.

As an alternate mounting means, although not shown, support post 14 may be of square or rectangular hollow form and consisting of two members, a first member attached, such as by welding if the members are metal, to base plate 12 and a second member attached to bottom support member 25, one of the two members being smaller than the other so as to mount inside the other. Although not shown, base plate 12 could have holes therein for receiving nails or pegs for securing the base plate to a mounting surface.

Target framework 20 can be formed of any suitable material such as the shown tubular members and include first and second interconnected target areas 22 and 24 formed on a common framework. As shown, the target framework includes bottom tube or bar member 25, which is shown clamped to, and supported by the support post 14 by clamp members 17 and 18. Alternately, target framework 20 may be formed of selectively configured (circular or rectangular) metal, plastic, rubber or other suitable material, and matingly connected as described above with bar member 25. Of course, methods other than clamp 18 can be used for attachment of members 14 and 25.

The first target area 22 is of an elongate generally rectangular form, with opposing generally parallel side tubular (or bar) members **22*a*, 22*b* having the lower ends thereof suitably secured to bottom member 25. Interconnecting cross member 22*c* spans the top ends of side members 22*a* and 22*b* and is suitable secured thereto, with the target area 22 thus being defined as a vertically elongate generally rectangular opening. Supported within the opening is a ball catching means, such as net 27, formed as a deep-V type net of cord, which has the periphery thereof secured, such as by tying, to the members 22*a*–22*c* and the interconnecting portion of bottom member 25**.

Figure 2:
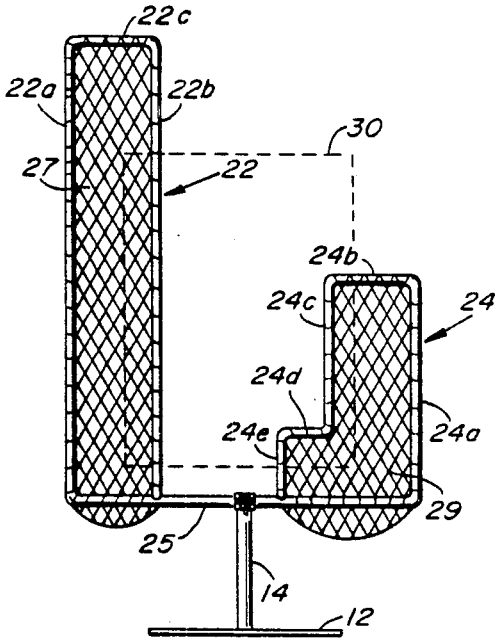
FIG. 2 is a front elevational view of the apparatus target areas of FIG. 1, with a dotted line depiction of a strike zone superimposed thereon.

Referring also to FIG. 2, as shown, there is a portion of target areas 22 and 24, shown in dotted lines which is defined as a strike zone, generally designated 30. These areas outside of the strike zone enables the pitcher to practice throwing the ball at selected locations outside of the strike zone, but yet very close to the strike zone so as to tempt the batter to swing.

The normal position of a batter with respect to this zone 30 would be to the right of the apparatus 10, as viewed in FIG. 2, with the batter facing the pitcher. As shown, the outer side member **22*a* of the target area 22 would generally correspond to the outer edge of the strike zone 30, that is, the edge furthest from the batter. The target area 22 portion of the strike zone 30 would generally correspond to what is known as an outside pitch. However, depending upon the pitcher's preference, the position of the batter could be to the left of the apparatus 10**, the pitcher having the option of turning the apparatus in any manner desired.

The second target area 24 is generally of smaller dimension, although this is not necessary, and of a somewhat reversed L-shaped configuration. As shown in FIG. 2, the second target area 24 would define a portion of the strike zone 30 (in dotted lines) which would correspond to a low and inside corner pitch, or low and outside pitch if the apparatus is reversed. This particular pitch is one of the more difficult pitches for a batter to hit effectively (inside or outside).

The corner pitch target area 24 includes a right side member **24*a* secured to and vertically perpendicularly extending from the main bottom member 25, with the height thereof terminating at a selected height within the strike zone 30. A relatively short transverse member 24*b* is secured to, and extends from the upper end of member 24*a* in an inward direction generally parallel to bottom member 25**.

Another short member **24*c* is secured to member 24*b* and extends vertically downward therefrom to intersect with another transverse short member 24*d* which, in turn connects to a short vertically extending member 24*e*, which has the other end thereof secured to the bottom member 25. The outline of the target area 24 is of the configuration of a rectangle or square with an inner upper corner removed. Suitable ball retaining means, such as a loose or V-shaped net 29 is suitably secured to the framework members 24*a*–24*e* and 25**.

With both target areas 22 and 24, the outermost edges thereof, that is sides **22*a* and 24*a*, are in proximate alignment with the outer edges of the strike zone 30 to provide a realistic overall target area. The width of target area 22 is small relative to the overall width of the strike zone 30, and the corner target area 24 is likewise a small target relative to the overall area of the strike zone 30**. With such dimensions, training for precision pitching may be accomplished.

Figure 3:
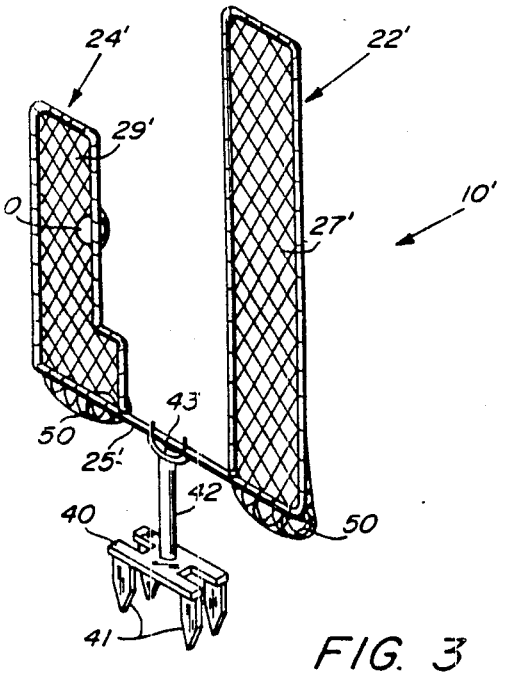
FIG. 3 is a perspective view of the apparatus in accordance with the invention, with a modified corner target area and an alternate support base, the apparatus shown such that the targets are on opposite sides.

FIG. 3 depicts another arrangement of the apparatus, generally designated 10', in which the traget area 24' is more elongate than the target area 24 of the apparatus 10, although target area 24' still includes the lower corner pitching target area. The support means of apparatus 10' includes a base 40 having a plurality of depending pointed stake members 41 for anchoring in soft earth, with a central upwardly extending post portion 42 having a rotary swivel coupling 43 secured thereto and to the bottom tubular (or bar) member 25'. The swivel coupling 43 is preferably lockable in two positions 180 degrees apart to facilitate pitching practice for right handed or left handed batters. As shown in FIG. 3, a number of baseballs 50 are captively retained in the nets 27' and 29' due to the deep pocket, or V-shape, of the nets.

The pitching training apparatus 10 or 10' may be readily constructed of sufficiently strong tubular (or other desired configuration) plastic or metal, and may be arranged for disassembly, if desired. Furthermoe, it is to be understood that the target areas may be arranged for high and inside pitches as well by providing a mirror image corner target area similar to target 24, in addition to, or in lieu of target area 24. Furthermore, it is to be understood that the apparatus 10, or 10', may be rotated 180 degrees to provide practice for left handed pitchers, or practice against right or left handed batters.

Figure 4:
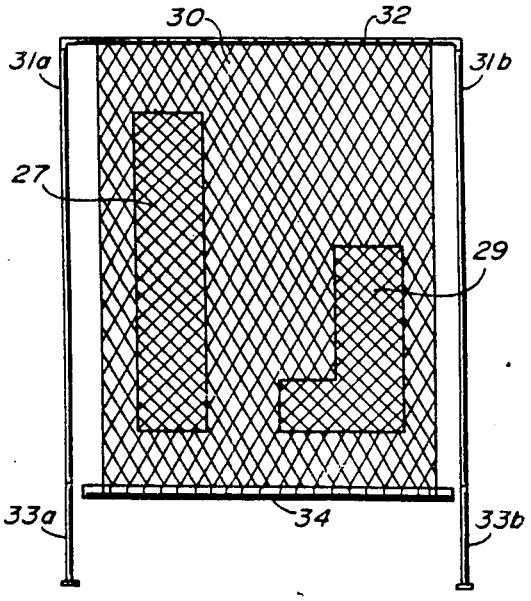
FIG. 4 is a front elevational view of another modified version of the baseball pitching training apparatus in accordance with the invention, with a the target areas mounted into a surrounding netting.

FIG. 4 shows yet another embodiment of the pitching training apparatus in accordance with the invention, and includes target areas 27 and 29 consisting of pockets of netting mounted within a surrounding netting 30, netting 30 hanging from a support bar 32, said support bar being a part of a support stand comprised of horizontal support bar 32 supported on either side by vertical members **31*a* and 31*b*, which are mounted respectively to support feet 33*a*, 33*b* to form the support stand. The bottomm of the netting 30 could be weighted such as by bar 34 to facilitate the netting assembly returning to its original position after being struck by a ball. The target areas 27 and 29** would of course be mounted on the surrounding netting respective to each other and the strike zone as previously described. The advantage of this embodiment would be to minimize the bouncing of balls off of target area support members since the pitcher would be throwing to a substantially all net structure.

The most simple embodiment would be the target areas only, the user to select any desired support means.

Thus, there is shown pitching targets which may be reversable and used on the inside or outside of the strike zone so that a pitcher can sharpen his precision in throwing fast balls, curve balls, or any other pitch in his repertoire. Generally, although it is to the descretion of the pitcher, the target 24 is desired to be outside for practice on curve balls with the target 22 inside for practice on fast balls, it being difficult to hit an outside curve ball or an inside fastball.

In any event, in accordance with the instant invention, the apparatus herein described enables a pitcher to train on those pitches which require more skill, and enhance the ability of the pitcher to retire the batter, that is, outside pitches and inside corner pitches.

Additionally, in accordance with the instant invention, the apparatus herein described enables a pitcher to train on those pitches which enables the pitcher to practice throwing the ball at selected locations outside of the strike zone, a portion of the target being outside of the strike zone.

While there have been shown and described preferred embodiments it is to be understood that various other adaptations and modifications may be made within the spirit and scope of the invention.

What is claimed is:

1. Baseball pitching training apparatus for defining an average strike zone, and for enabling one to practice pitching to selected locations contiguous to the outside edge of a strike zone, said apparatus comprising:

a base fabric encompassing said strike zone;

support means for vertically supporting said base fabric;

a first target area on said base fabric defined by a first elongate generally vertical rectangular opening at a position generally corresponding to a first selected vertical edge of said strike zone;

a second target area on said base fabric defined by a second vertically extending opening of substantially reversed L-shaped configuration and at a position generally corresponding to a second selected vertical edge of said strike zone, said first and second target areas being spaced apart on said base fabric one from the other with this space being, at least in part, an area corresponding to the center of the strike zone;

ball retaining means within each of said first and second target areas; said support means includes a horizontal support member and first and second vertical support members, each of said vertical support members having its upper end attached to a respective end of said horizontal support member and its lower end coacting with a support surface for supporting said apparatus, and said base fabric having its upper edge attached to said horizontal support member and being suspended in a substantially vertical plane.

2. The apparatus of claim 1 wherein said ball retaining means includes pockets of netting mounted on said base fabric.

3. The apparatus of claim 2 wherein the vertically extending portion of said second opening is shorter than the vertically extending portion of said first opening.

4. The apparatus of claim 1 wherein weight means is attached to the bottom of said base fabric for facilitating that the said base fabric returns substantially to its original vertical position after being struck by a ball.

5. The apparatus of claim 1 wherein the position and configuration of said second target area is at that portion of the strike zone corresponding to a selected inside/outside low corner pitch.

6. The apparatus of claim 1 wherein said pockets ball retaining means are formed of netting material.

* * * * *